US012480268B2

(12) United States Patent
Klein

(10) Patent No.: US 12,480,268 B2
(45) Date of Patent: Nov. 25, 2025

(54) COLLAPSIBLE BARRIER AND A SYSTEM COMPRISING THE SAME

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 866 days.

(21) Appl. No.: 17/421,745

(22) PCT Filed: Jan. 9, 2020

(86) PCT No.: PCT/IB2020/050142
§ 371 (c)(1),
(2) Date: Jul. 9, 2021

(87) PCT Pub. No.: WO2020/144612
PCT Pub. Date: Jul. 16, 2020

(65) Prior Publication Data

US 2022/0090335 A1 Mar. 24, 2022

Related U.S. Application Data

(60) Provisional application No. 62/790,055, filed on Jan. 9, 2019.

(51) Int. Cl.
*E01F 13/04* (2006.01)
*E01F 13/02* (2006.01)

(52) U.S. Cl.
CPC ..... *E01F 13/044* (2013.01); *E01F 13/02* (2013.01)

(58) Field of Classification Search
CPC ..... E01F 13/02; E01F 13/044
USPC ..... 404/6, 9; 116/63 R, 63 T, 63 C
See application file for complete search history.

(56) References Cited

U.S. PATENT DOCUMENTS 1,647,012 A * 10/1927 Morris ..... E01F 9/602 404/11
2,737,740 A 3/1956 Genoe
2,783,055 A 2/1957 Michaud
2,877,476 A * 3/1959 Kraszewski ..... A47L 13/30 401/48
2,961,786 A 11/1960 Lowmaster
3,135,235 A * 6/1964 Romano ..... E01F 9/688 116/63 P
3,334,856 A * 8/1967 Moncure ..... F16M 11/242 116/63 P
3,593,681 A * 7/1971 Sernovitz ..... B60Q 7/005 116/63 P (Continued)

FOREIGN PATENT DOCUMENTS

CN 2853891 Y 1/2007
CN 204626286 U 9/2015

(Continued)

*Primary Examiner* — Raymond W Addie
(74) *Attorney, Agent, or Firm* — William H. Dippert; Laurence A. Greenberg; Werner H. Stemer

(57) ABSTRACT

A collapsible barrier is provided that comprises multiple collapsible elements, wherein each one of the collapsible elements has a bottom edge, a first side edge, and a second side edge, wherein the bottom edge is configured to pivot so as to allow the collapsible element to move between an upright state and a horizontal state, and wherein the collapsible elements are adjacently arranged so that the collapsible barrier is either in an upright state when the multiple elements are in an upright state, or in a horizontal state when the multiple collapsible elements are in a horizontal state.

17 Claims, 14 Drawing Sheets

(56) References Cited

U.S. PATENT DOCUMENTS

| | | | | |
|---|---|---|---|---|
| 3,982,734 | A | 9/1976 | Walker | |
| 4,158,514 | A | 6/1979 | Dickinson | |
| 4,279,105 | A | 7/1981 | Cameron | |
| 4,354,771 | A | 10/1982 | Dickinson | |
| 4,367,975 | A | 1/1983 | Tyers | |
| 4,426,801 | A * | 1/1984 | Gates | E01F 9/688 40/610 |
| 4,462,145 | A * | 7/1984 | Schulze | E01F 9/688 52/DIG. 10 |
| 4,624,600 | A | 11/1986 | Wagner et al. | |
| 4,705,426 | A | 11/1987 | Perea | |
| 4,762,439 | A | 8/1988 | Carlyle | |
| 4,773,629 | A | 9/1988 | Yodock | |
| 4,875,028 | A * | 10/1989 | Chou | B60Q 7/00 116/63 T |
| 4,952,910 | A * | 8/1990 | Straten | B60Q 7/00 340/474 |
| 4,998,843 | A | 3/1991 | Mothe | |
| 5,188,342 | A | 2/1993 | Ouellette et al. | |
| 5,217,318 | A | 6/1993 | Peppel | |
| 5,225,254 | A * | 7/1993 | Foulke | E01F 9/688 229/116 |
| 5,535,555 | A * | 7/1996 | Boyd | E01F 9/635 248/548 |
| 5,588,774 | A | 12/1996 | Behan | |
| 5,627,513 | A * | 5/1997 | Weed | B60Q 7/00 116/63 P |
| 5,798,102 | A | 8/1998 | McMichael et al. | |
| 5,882,140 | A | 3/1999 | Yodock, Jr. et al. | |
| 5,950,969 | A * | 9/1999 | Bennett | E01F 9/688 248/472 |
| 5,975,791 | A | 11/1999 | McCulloch | |
| 6,409,418 | B1 | 6/2002 | Blair et al. | |
| 6,672,799 | B2 * | 1/2004 | Earl | E02B 3/04 405/116 |
| 6,702,512 | B1 | 3/2004 | Reale | |
| 6,718,670 | B2 * | 4/2004 | Wang | B60Q 7/005 116/63 T |
| 6,905,281 | B2 | 6/2005 | Kang | |
| 7,025,526 | B2 | 4/2006 | Blair | |
| 7,172,176 | B1 | 2/2007 | Eastland | |
| 7,437,845 | B2 * | 10/2008 | Huang | G09F 13/16 116/63 P |
| 7,918,622 | B2 | 4/2011 | Whitford | |
| 7,950,173 | B2 * | 5/2011 | Jedlicka | G09F 15/0025 248/188.7 |
| 8,256,985 | B2 | 9/2012 | Ashmead | |
| 9,739,328 | B1 | 8/2017 | Degroot et al. | |
| 9,834,927 | B2 | 12/2017 | Huff | |
| 9,945,084 | B1 | 4/2018 | Warford | |
| 10,266,999 | B2 | 4/2019 | Rothschild | |
| 10,415,198 | B1 * | 9/2019 | Thomas | E01F 13/12 |
| 2004/0237876 | A1 * | 12/2004 | Huang | B60Q 7/00 116/63 T |
| 2006/0076544 | A1 | 4/2006 | Kurple | |
| 2009/0028639 | A1 * | 1/2009 | Thomas | E01F 9/688 404/9 |
| 2009/0308304 | A1 * | 12/2009 | Ho | G09F 13/16 116/63 T |
| 2010/0178104 | A1 | 7/2010 | Bare et al. | |
| 2012/0012133 | A1 | 1/2012 | Riscica | |
| 2012/0017743 | A1 | 1/2012 | Pierret et al. | |
| 2012/0121336 | A1 | 5/2012 | Arciszewski | |
| 2012/0177439 | A1 | 7/2012 | More et al. | |
| 2015/0114281 | A1 * | 4/2015 | Bartuli | G09F 13/16 116/63 T |
| 2015/0117948 | A1 * | 4/2015 | Carlson | E01F 7/00 404/6 |
| 2019/0161927 | A1 | 5/2019 | Pan | |
| 2019/0257045 | A1 * | 8/2019 | Bock, II | E01F 13/123 |

FOREIGN PATENT DOCUMENTS

| | | | |
|---|---|---|---|
| CN | 106049307 | A | 10/2016 |
| CN | 106468049 | A | 3/2017 |
| DE | 10108586 | A1 | 9/2002 |
| EP | 0253656 | A1 | 1/1988 |
| EP | 0465748 | A1 | 1/1992 |
| EP | 0823510 | A2 | 2/1998 |
| EP | 1293686 | A2 | 3/2003 |
| EP | 2107163 | A2 | 10/2009 |
| EP | 3323942 | A1 | 5/2018 |
| EP | 3447194 | A1 | 2/2019 |
| FR | 2854413 | A1 | 11/2004 |
| GB | 1478840 | A | 7/1977 |
| GB | 2261006 | A | 5/1993 |
| GB | 2430964 | A | 4/2007 |
| GR | 20050100073 | A | 10/2006 |
| IL | 284568 | A | 8/2021 |
| IL | 285873 | A | 10/2021 |
| IL | 287502 | A | 12/2021 |
| IL | 266217 | B1 | 3/2023 |
| JP | 2000178932 | A | 6/2000 |
| JP | 4461330 | B2 | 5/2010 |
| JP | 2013221274 | A | 10/2013 |
| WO | 2007105940 | A1 | 9/2007 |
| WO | 2016030886 | A1 | 3/2016 |
| WO | 2019016812 | A1 | 1/2019 |
| WO | 2019097526 | A1 | 5/2019 |

* cited by examiner

COLLAPSIBLE BARRIER AND A SYSTEM COMPRISING THE SAME

CROSS-REFERENCE TO RELATED PATENT APPLICATIONS

This patent application is a U.S. National Phase filing under 35 U.S.C. § 371 of PCT Patent Application No. PCT/IB2020/050142, filed Jan. 9, 2020, which is based upon and claims the priority of U.S. Provisional Patent Application Ser. No. 62/790,055, filed Jan. 9, 2019, each of which is incorporated herein by reference in its entirety.

FIELD

The present subject matter relates to barriers. More particularly, the present subject matter relates to collapsible barriers.

BACKGROUND

Different barriers to block pedestrians as well as vehicles of different types and sizes are known in the art and the inventor of the subject matter described herein also describes in other documents effective barriers configured to block vehicles, especially vehicles aimed at getting into crowded places in very high speed. Such barriers that are erected from the ground can be fixed in place or portable and can be remotely controlled.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

There is a need to temporarily block passage of vehicles, while allowing passage of pedestrians, or temporarily allow passage of vehicles and pedestrians.

According to one aspect of the present subject matter, there is provided A collapsible barrier comprising multiple collapsible elements, wherein each one of the collapsible elements has a bottom edge, a first side edge, and a second side edge, wherein the bottom edge is configured to pivot so as to allow the collapsible element to move between an upright state and a horizontal state, and wherein the collapsible elements are adjacently arranged so that the collapsible barrier is either in an upright state when the multiple elements are in an upright state, or in a horizontal state when the multiple collapsible elements are in a horizontal state.

According to one embodiment, the collapsible element is triangular.

According to one embodiment, the collapsible element comprising at least four edges of which one edge is a top edge.

According to one embodiment, the collapsible element is quadrangular.

According to one embodiment, an intermediate state is a transition state between the upright state and the horizontal state.

According to one embodiment, the collapsible barrier in the upright state is configured to block passage of a vehicle, and wherein the collapsible barrier in the horizontal state is configured to allow passage of the vehicle.

According to one embodiment, the collapsible element is pivotally connected to a surface.

According to one embodiment, the collapsible element further comprising at least one hinge attached to the bottom edge, and configured to be fixed to the surface.

According to one embodiment, the hinge is configured to be permanently fixed to the surface.

According to one embodiment, the hinge is configured to be removably fixed to the surface.

According to one embodiment, the hinge is configured to be fixed to the surface in a manner that withstands an impact of a moving vehicle.

According to one embodiment, the collapsible elements are configured to form an enclosed shape when in an upright state.

According to one embodiment, the shape of the collapsible elements allows at least partial attachment of the at least first side edge and the second side edge of adjacent collapsible elements in an upright state.

According to one embodiment, the collapsible element is configured to be in a horizontal state in a manner that allows passage of a vehicle over the collapsible element.

According to one embodiment, at least one of the collapsible elements is configured to be erected and collapsed manually.

According to one embodiment, at least one of the collapsible elements is configured to be erected and collapsed automatically.

According to one embodiment, the collapsible elements are configured to be removably connected one to the other.

According to one embodiment, the collapsible elements are configured to be removably connected one to the other when in an upright state.

According to one embodiment, the collapsible elements are configured to be connected with a connecting element configured to connect at least two adjacent collapsible elements.

According to one embodiment, the collapsible element further comprising at least one connecting element receiver configured to accommodate the connecting element.

According to one embodiment, the connecting element is a connecting rod.

According to one embodiment, the connecting element receiver has a tube-like structure positioned along a side edge of a collapsible element.

According to one embodiment, the collapsible element comprising at least one connecting element receiver attached to the first side edge.

According to one embodiment, the collapsible element comprising at least one connecting element receiver attached to the second side edge.

According to one embodiment, the collapsible element comprising at least one connecting element receiver attached to the first side edge, and at least one connecting element receiver attached to the second side edge.

According to one embodiment, in two adjacent collapsible elements, a connecting element receiver of one collapsible element is positioned above a connecting element receiver of another collapsible element when the adjacent collapsible elements are in an upright state, in a manner that allows insertion of a connecting rod into the connecting element receivers that are positioned one above the other.

According to one embodiment, the barrier further comprising a cover configured to connect to a top of the collapsible barrier when in an upright state.

According to one embodiment, the cover is configured to removably connect to the top of the collapsible barrier when in an upright state.

According to one embodiment, when the collapsible barrier is in an upright state, the top edges of the collapsible elements enclose an opening on top of the collapsible barrier.

According to one embodiment, the barrier further comprising a cover configured to fit and cover the opening.

According to one embodiment, the cover is configured to removably fit and cover the opening.

According to one embodiment, the cover is configured to connect to the collapsible elements in the upright state.

According to one embodiment, the cover is configured to tighten the connection of the collapsible elements one to the other in the upright state.

According to one embodiment, the barrier further comprising at least one light source.

According to one embodiment, the barrier further comprising a base configured to serve as a surface to which the collapsible elements are fixed.

According to one embodiment, the base is configured to be permanently placed on the surface.

According to one embodiment, the base is configured to be removably placed on the surface.

According to one embodiment, the base is configured to be portable.

A collapsible barrier system is provided that comprises multiple collapsible barriers as explained herein before.

A collapsible barrier system is provided that comprises multiple collapsible barriers as explained herein before, wherein the base of the collapsible barrier is configured to be connected to the base of an adjacent collapsible barrier.

According to one embodiment, the base of the collapsible barrier is configured to be permanently connected to the base of the adjacent collapsible barrier.

According to one embodiment, the base of the collapsible barrier is configured to be removably connected to the base of the adjacent collapsible barrier.

In accordance with another embodiment, a method for collapsing a collapsible barrier from the upright state to the horizontal state is provided, wherein the collapsible barrier comprises multiple collapsible elements adjacently arranged, and wherein the collapsible element comprising at least:

a bottom edge configured to be pivotally connected to a surface;

a first side edge; and a second side edge, and wherein the collapsible element is configured to be either in an upright state, or in a horizontal state, and wherein the collapsible barrier is configured to be either in an upright state when the multiple elements are in an upright state, or in a horizontal state when the multiple collapsible elements are in a horizontal state, the method comprising:

providing the collapsible barrier in the upright state; and further collapsing the collapsible elements and bringing the collapsible elements to the horizontal state.

According to one embodiment, the collapsible barrier further comprising a cover configured to connect to a top of the collapsible barrier when in an upright state, the method further comprising before the collapsing the collapsible elements and bringing the collapsible elements to the intermediate state: removing the cover from the collapsible barrier.

In accordance with yet another embodiment, a method for erecting a collapsible barrier from the horizontal state to the upright state is provided, wherein the collapsible barrier, comprising multiple collapsible elements adjacently arranged, and wherein the collapsible element comprising at least:

a bottom edge, configured to be pivotally connected to a surface;

a first side edge; and a second side edge, and wherein the collapsible element is configured to be either in an upright state, or in a horizontal state, and wherein the collapsible barrier is configured to be either in an upright state when the multiple elements are in an upright state, or in a horizontal state when the multiple collapsible elements are in a horizontal state, the method comprising:

providing the collapsible barrier in a horizontal state;

erecting the collapsible elements and bringing the collapsible elements to an intermediate state; and further erecting the collapsible elements and bringing the collapsible elements to the upright state.

According to one embodiment, the collapsible barrier further comprising a cover configured to connect to a top of the collapsible barrier when in an upright state, the method further comprising after the further erecting the collapsible elements and bringing the collapsible elements to the upright state: covering the collapsible barrier with the cover.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms can be embodied in practice.

In the drawings.

DESCRIPTION OF THE PREFERRED EMBODIMENTS

Figure 1:
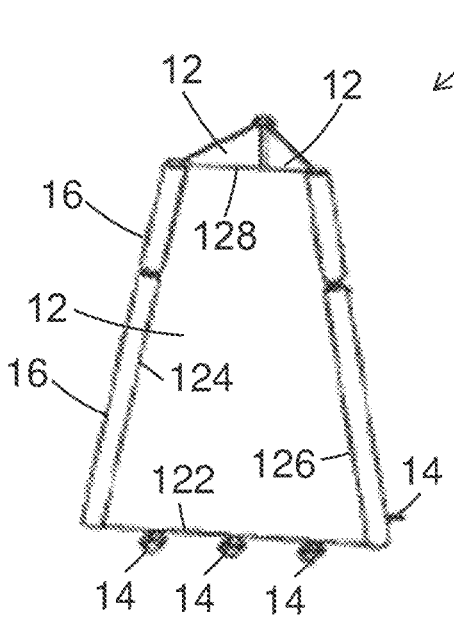
FIG. 1 schematically illustrates, according to an exemplary embodiment, a front perspective view of a collapsible barrier in an upright state.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

The term "pedestrians" as disclosed herein relates to pedestrians as well as objects similar in size, for example bicycles, motorcycles, animals and the like.

A collapsible barrier is provided that comprises multiple collapsible elements, wherein each one of the collapsible elements has a bottom edge, a first side edge, and a second side edge, wherein the bottom edge is configured to pivot so as to allow the collapsible element to move between an upright state and a horizontal state, and wherein the collapsible elements are adjacently arranged so that the collapsible barrier is either in an upright state when the multiple elements are in an upright state, or in a horizontal state when the multiple collapsible elements are in a horizontal state.

An intermediate state is a transition state between the upright state and the horizontal state, and the collapsible element can be in the intermediate state, either when the collapsible element collapses from the upright state to the horizontal state, or when the collapsible element erects from the horizontal state to the upright state.

Figure 2:
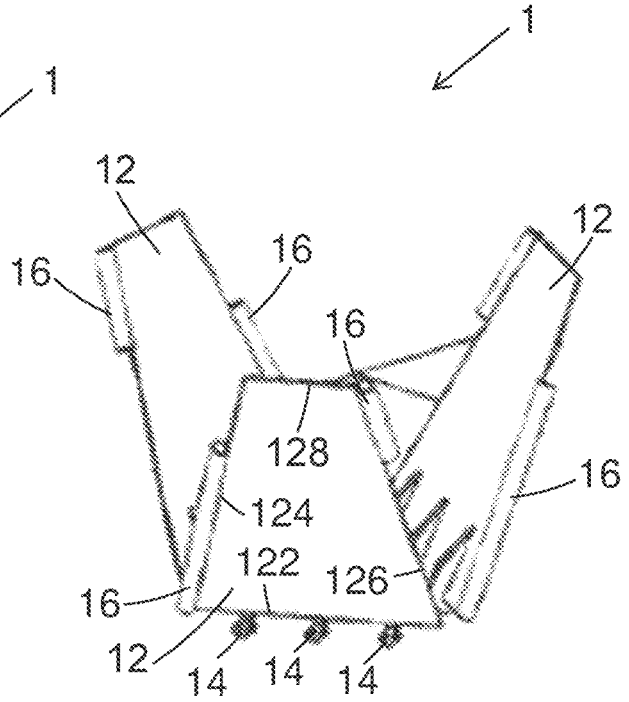
FIG. 2 schematically illustrates, according to an exemplary embodiment, a front perspective view of a collapsible barrier in an intermediate state.
Figure 3:
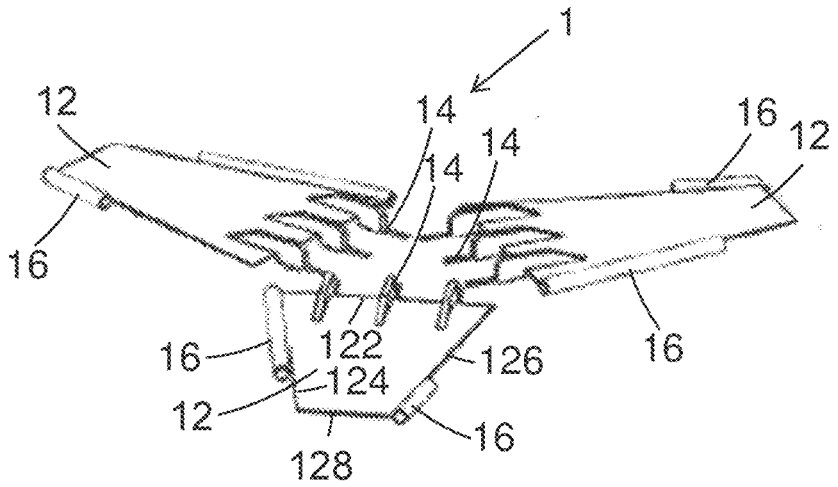
FIG. 3 schematically illustrates, according to an exemplary embodiment, a front perspective view of a collapsible barrier in a horizontal state.

Reference is now made to FIGS. 1, 2, and 3 schematically illustrating, according to an exemplary embodiment, a front perspective view of a collapsible barrier in an upright state, an intermediate state, and a horizontal state, respectively.

According to one embodiment, the collapsible barrier 1 comprises multiple collapsible elements 12. The collapsible barrier 1, illustrated for example in FIGS. 1-3, comprises three collapsible elements 12. It should be noted that this number of collapsible elements 12 is exemplary only, and should not be considered as limiting the scope of the present subject matter. Any number of collapsible elements 12, of which the collapsible barrier 1 is comprised, is under the scope of the present subject matter.

According to one embodiment, the collapsible element 12 can be substantially flat in shape, and can have at least three edges. According to one exemplary embodiment, the collapsible element 12 comprises three edges and has a triangular shape (not shown). According to another embodiment, the collapsible element 12 comprises at least four edge. According to yet another exemplary embodiment, the collapsible element 12 comprises four edges and has a quadrangular shape, as illustrated for example in FIGS. 1-3. Nevertheless, the collapsible element 12 can have any shape known in the art that may form a stable structure when assembled into a barrier.

According to one embodiment, the collapsible element can comprise at least three edges a bottom edge 122, configured to be pivotally connected to a surface (not shown in these figures), a first side edge 124 and a second side edge 126. For example, a triangular collapsible element 12 can comprise these three edges—the bottom edge 122, the first side edge 124 and the second side edge 126 (not shown). According to another embodiment, the collapsible element 12 comprises at least four edges having a bottom edge 124, at least two side edges, and a top edge. For example, a quadrangular collapsible element 12, illustrated for example in FIGS. 1-3, comprises the aforementioned edges—the bottom edge 122, the first side edge 124 and the second side edge 126, as well as a top edge 128.

According to one embodiment, each collapsible element 12 is configured to be either in an upright state, as illustrated in FIG. 1, in a horizontal state, as illustrated in FIG. 3, or in an intermediate state, as illustrated in FIG. 2. When the collapsible elements 12 are in an upright state, they form together a collapsible barrier 1 in an upright state that is configured to block passage of a vehicle. When the collapsible elements 12 are in a horizontal (collapsed) state, they form together a collapsible barrier in a horizontal state that is configured to allow passage of a vehicle. During transition between the upright state and the horizontal state, and vice versa, each collapsible element 12 is in an intermediate state.

According to one embodiment, the collapsible element 12 is configured to be pivotally connected to a surface in a manner that allows the collapsible element 12 to pivot between the upright state, the horizontal state, and the intermediate state. According to one embodiment, the surface is the ground. The term "ground" as disclosed herein relates to any surface known in the art on which pedestrians and vehicles can move, for example a road, a pavement, a path, a trail, a walkway, a highway, soil, ground, combination thereof, and the like. The collapsible element 12 is configured to be pivotally connected to a surface in a manner that in one hand it fixes the collapsible element 12 to the surface strongly enough to withstand an impact of a moving vehicle attempting to cross the collapsible barrier 1 in the upright state, and on the other hand allows shifting the collapsible element 12 between the upright state and the horizontal state, namely being in an intermediate state. Any mechanism known in the art that allows pivotally connecting of the collapsible element 12 to a surface according to embodiments described herein, is under the scope of the present subject matter.

For example, as illustrated in FIGS. 1-3, each collapsible element 12 comprises at least one hinge 14. According to one embodiment, the at least one hinge 14 is attached to the bottom edge 122 of the collapsible element 12 and fixed to a surface. The hinge 14 is configured to be fixed to a surface by any mechanism known in the art, for example by screwing, nailing, welding, soldering, and the like. Thus, according to one embodiment, the hinge 14 is configured to be permanently fixed to a surface, and according to another embodiment, the hinge 14 is configured to be removably fixed to a surface. According to a further embodiment, the hinge 14 is configured to be fixed to a surface in a manner that withstands an impact of a moving vehicle, for example an impact of a moving vehicle attempting to cross the collapsible barrier 1 in an upright state.

According to an additional embodiment, the hinge 14 is configured to serve as a pivot about which the collapsible element 12 can pivot, thus allowing shifting of the collapsible element 12 between an upright state and a horizontal state, and vice versa. Any mechanism known in the art that allows the collapsible element 12 to pivot about the hinge 14 is under the scope of the present subject matter, for example a pivot, a flexible element, a foldable element, a combination therein, and the like.

According to one embodiment, the collapsible elements 12 of the collapsible barrier 1 are configured to form an enclosed shape when in an upright state, as illustrated in FIG. 1. In other words, when in the upright state, at least the first side edge 124 and the second side edge 126 of the collapsible elements 12 are configured to at least partially touch each other. This embodiment contributes to the strength of the collapsible barrier 1 in the upright state, for example to withstand an impact of a moving vehicle attempting to cross the collapsible barrier 1 when in the upright state. Therefore, the shape of the collapsible elements 12 allows at least partial attachment of the at least first side edge 124 and the second side edge 126 of adjacent collapsible elements 12 in an upright state. For example, in an embodiment where the collapsible barrier 1 comprises three collapsible elements 12, as illustrated in FIGS. 1-3, the collapsible elements 12 can have substantially trapezoid-like shape. It should be noted though, that the shape of the collapsible elements 12 illustrated for example in FIGS. 1-3 is exemplary only and should not be considered at limiting the scope of the present subject matter. Any shape of the collapsible elements 12 is under the scope of the present subject matter.

According to one embodiment, in the horizontal state, illustrated for example in FIG. 3, the collapsible element 12 is configured to be in a horizontal state in a manner that allows passage of a vehicle over the collapsible element 12. Thus, for example, the collapsible element 12 can be substantially flat and substantially parallel to the surface on which it lies in the horizontal (collapsed) state.

According to one embodiment, the erecting of at least one of the collapsible elements 12 from the horizontal state to the upright state can be performed manually, namely by a person erecting the collapsible elements 12 with his hands, or by operating a tool, for example a rope, a hook, a combination therein, and the like. According to another embodiment, the erecting of at least one of the collapsible elements 12 from the horizontal state to the upright state can be performed automatically, namely without a direct involvement of a person, for example by a motor configured to erect at least one collapsible element 12. According to a further embodiment, the collapsing of at least one of the collapsible elements 12 from the upright state to the horizontal state can be performed manually, namely by a person collapsing the collapsible elements 12 with his hands, or by operating a tool, for example a rope, a hook and the like. According to yet a further embodiment, the collapsing of at least one of the collapsible elements 12 from the upright state to the horizontal state can be performed automatically, namely without a direct involvement of a person, for example by a motor configured to collapse at least one collapsible element 12.

Thus, according to one embodiment, at least one of the collapsible elements 12 is configured to be erected and collapsed manually. According to another embodiment, the collapsible barrier 1 further comprising a motor (not shown in the figures) configured to erect and collapse at least one collapsible element 12. In the cases the transition between the states is automatic, its operation is performed remotely using a remote control.

According to one embodiment, the collapsible elements 12 are configured to be removably connected one to the other, for example when the collapsible elements 12 are either in a horizontal state, or in an upright state. For example, the collapsible elements 12 are configured to be removably connected at the upright state in order to increase the strength and stability of the collapsible barrier 1, for example to increase the ability of the collapsible barrier 1, in an upright state, to withstand an impact of a moving vehicle attempting to cross the collapsible barrier 1 in the upright state. Any mechanism known in the art for removably connecting the collapsible elements 12 is under the scope of the present subject matter, for example tying, screwing, nailing and the like. Another example is using a connecting element configured to connect at least two adjacent collapsible elements 12, for example in the upright state. A rope, or a wire thread, a cable tie, a restraint, a combination therein or the like can be considered as a connecting element. According to one embodiment, the connecting element can be part of the collapsible barrier 1, or of a system comprising multiple collapsible barriers 1. According to another embodiment, the connecting element cannot be part of the collapsible barrier 1 or a system comprising multiple collapsible parries 1, but rather be provided by a user.

According to one embodiment, the collapsible element 12 further comprising at least one connecting element receiver 16 configured to accommodate the connecting element.

According to one embodiment, the connecting element is a connecting rod.

Accordingly, the connecting element receiver 16 is configured to accommodate the connecting rod (not shown). The connecting element receiver 16 that is configured to accommodate a connecting rod has a tube-like structure positioned along a side edge of a collapsible element 12, as can be seen, for example, in FIG. 1. According to one embodiment, the collapsible element 12 can comprise at least one connecting element receiver 16 attached to the first side edge 124. According to another embodiment, the collapsible element 12 can comprise at least one connecting element receiver 16 attached to the second side edge 126. According to yet another embodiment, the collapsible element 12 can comprise at least one connecting element receiver 16 attached to the first side edge 124 and at least one connecting element receiver 16 attached to the second side edge 126. As can be seen in FIG. 1, for example, in two adjacent collapsible elements 124, a connecting element receiver 16 of one collapsible element 12 is positioned above a connecting element receiver 16 of another collapsible element 12 when the adjacent collapsible elements 12 are in an upright state, in a manner that allows insertion of a connecting rod into the connecting element receivers 16 that are positioned one above the other. As a result, the two adjacent collapsible elements 12 become connected, while the rod holds them together.

According to one embodiment, the length of the connecting element receiver 16 is shorter than the length of the side edge to which the connecting element receiver 16 is attached, as can be seen for example in FIGS. 2-3. According to another embodiment, when the collapsible elements 12 are in an upright state, the connecting element receiver 16 attached to a side edge of one collapsible element 12 is not parallel to a connecting element receiver 16 attached to an adjacent side edge of an adjacent collapsible element 12, as can be seen for example in FIG. 1. This embodiment allows insertion of a connecting rod into a connecting element receiver 16 of one the collapsible elements 12 and into a connecting element receiver 16 of an adjacent collapsible element 12. In this way, the connecting rod holds the adjacent collapsible elements 12 together, thus increasing the strength and the stability of the collapsible barrier 1, and particularly increasing the ability of the collapsible barrier 1 to withstand an impact of a moving vehicle attempting to cross the collapsible barrier 1 in the upright state.

Figure 4:
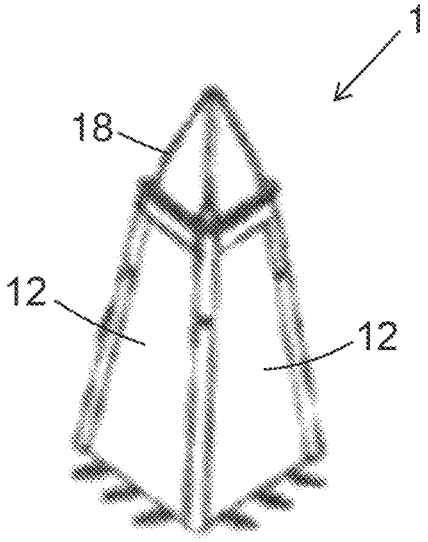
FIG. 4 schematically illustrates, according to an exemplary embodiment, a front perspective view of a collapsible barrier in an upright state, further comprising a cover.
Figure 5:
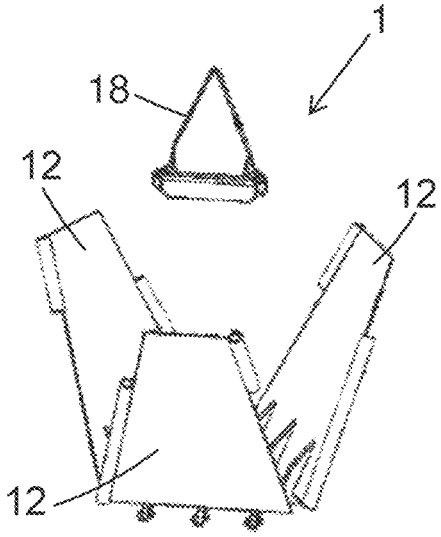
FIG. 5 schematically illustrates, according to an exemplary embodiment, a front perspective view of collapsible barrier in an intermediate state, further comprising a cover.
Figure 6:
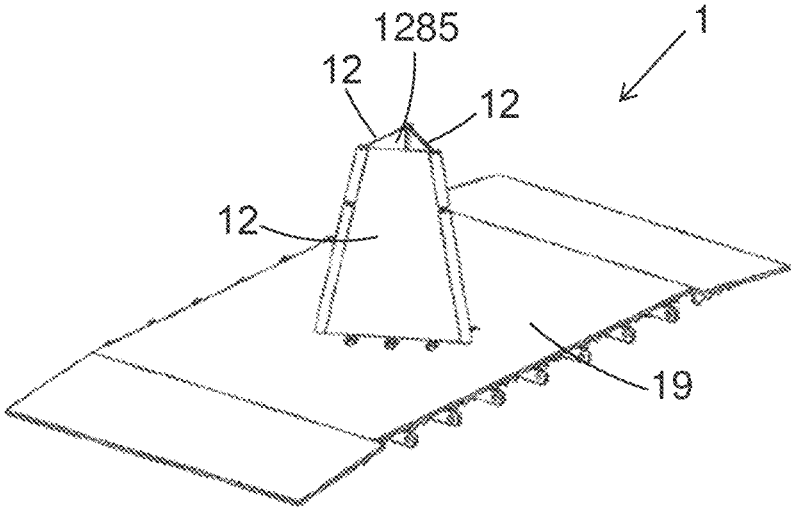
FIG. 6 schematically illustrates, according to an exemplary embodiment, a front perspective view of collapsible barrier in an upright state, the collapsible barrier mounted on a base.

Reference is now made to FIGS. 4 and 5, schematically illustrating, according to exemplary embodiments, a front perspective view of a collapsible barrier in an upright state and in an intermediate state, respectively, further comprising a cover and to FIG. 6 that schematically illustrates, according to an exemplary embodiment, a front perspective view of collapsible barrier in an upright state, the collapsible barrier mounted on a base.

According to one embodiment, when the collapsible element 12 comprises at least four edges, including a top edge, and the collapsible barrier 1 is in an upright state, the top edges of the collapsible elements 12 enclose an opening formed at the top of the collapsible barrier 1. For example, as can be seen in FIG. 6, when the collapsible element 12 comprises four edges, the top edges 128 of the collapsible elements 12 enclose an opening 1285 on top of the collapsible barrier 1. Collapsible barrier 1 is shown in FIG. 6 to be mounted on surface 19. The surface with the barrier can be moved from place to place according to needs.

According to one embodiment, the collapsible barrier 1 can further comprise a cover 18 configured to connect to a top of the collapsible barrier 1 when in an upright state. According to another embodiment, the cover 18 is configured fit and cover the opening 1285 on top of the collapsible barrier 1, when the collapsible barrier 1 is in an upright state. According to still another embodiment, the cover 18 is configured to serve as a connecting element. As such, according to a further embodiment, the cover 18 is configured to connect the collapsible elements 12 in the upright state. According to yet a further embodiment, the cover 18 is configured to tighten the connection of the collapsible elements 12 one to the other in the upright state. This embodiment can increase the ability of the collapsible barrier 1 to withstand an impact of a moving vehicle attempting to cross the collapsible barrier 1 in the upright state.

According to one embodiment, the collapsible barrier 1 further comprises at least one light source or a reflecting element configured to emit light, for example during dark periods, for example in order to increase the visibility of the collapsible barrier 1, for example in an upright state, in conditions when visibility conditions are limited, for example during the night, in case of fog, or a dust storm, or a heavy rain, combination therein, and the like. According to another embodiment, the at least one light source or reflector is attached to at least one collapsible element 12. According to yet another embodiment, the at least one light source is attached to the cover 18. According to still another embodiment, the at least one light source or reflector is attached to at least one collapsible element 12 and to the cover 18.

Figure 7:
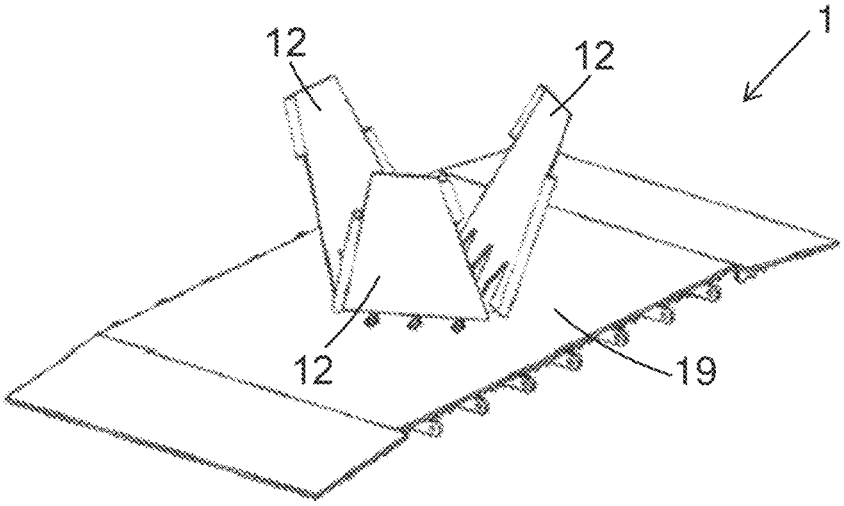
FIG. 7 schematically illustrates, according to an exemplary embodiment, a front perspective view of a collapsible barrier in an intermediate state, the collapsible barrier comprises a base.
Figure 8:
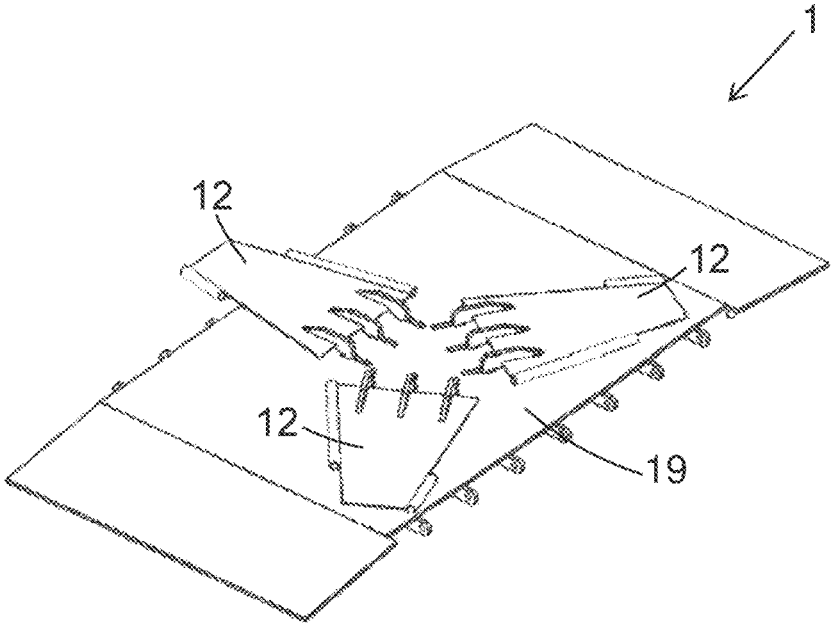
FIG. 8 schematically illustrates, according to an exemplary embodiment, a front perspective view of a collapsible barrier in a horizontal state, the collapsible barrier comprises a base.

Referring now to FIG. 7 and FIG. 8 schematically illustrating, according to an exemplary embodiment, a front perspective view of a collapsible barrier in an intermediate state and a horizontal (collapsed) state, respectively, the collapsible barrier mounted on a base.

According to one embodiment, the collapsible barrier 1 can further comprise a base 19, configured to serve as a surface onto which the collapsible elements 12 of the collapsible barrier 1 are mounted and connected according to embodiments described herein. For example, a collapsible element 12 can be connected to the base 19 by using at least one hinge 14 according to embodiments described herein.

According to one embodiment, the base 19 is configured to be placed on any type of surface known in the art, for example on a road. According to another embodiment, the base 19 is configured to allow passage of pedestrians and vehicles over it. According to a further embodiment, the base 19 is configured to be permanently placed on a surface. According to yet a further embodiment, the base is configured to be removably placed on a surface. According to still a further embodiment, the base 19 is configured to be portable, namely being moved from one place to the other, for example in order to be placed in places according to needs, conditions and circumstances that demand placement, or removal, of the base 19 in particular, or of the collapsible barrier 1 in particular.

The base 19 can have any shape and size known in the art, also having reinforcing elements, and be made of any material known in the art, giving rise to the embodiments of the base 19 described herein.

Reference is now made to FIGS. 9-14 schematically illustrating, according to an exemplary embodiment, a front perspective view, a side view, and a top view, respectively. of collapsible barrier in an upright state, an intermediate state, and in a horizontal state in a top view, and side view, respectively, the collapsible barrier comprises a base and a cover.

Figure 9:
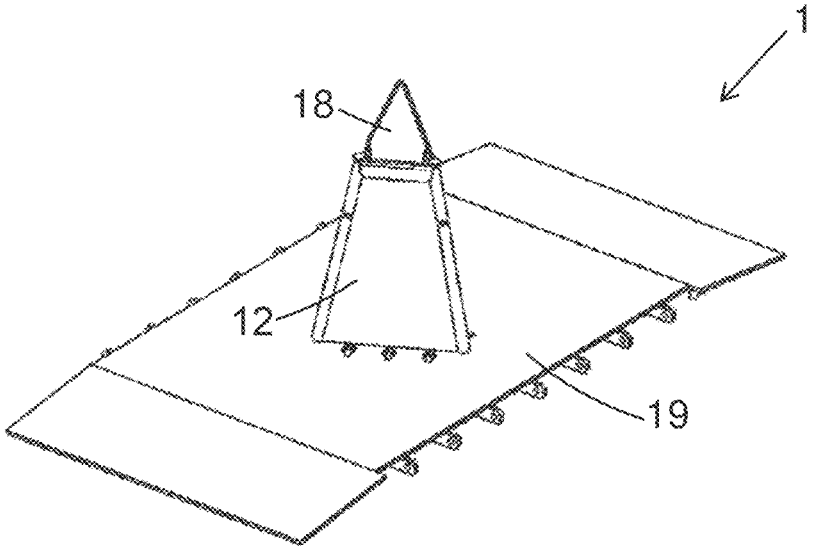
FIG. 9 schematically illustrates, according to an exemplary embodiment, a front perspective view of collapsible barrier in an upright state, the collapsible barrier comprises a base and a cover.
Figure 10:
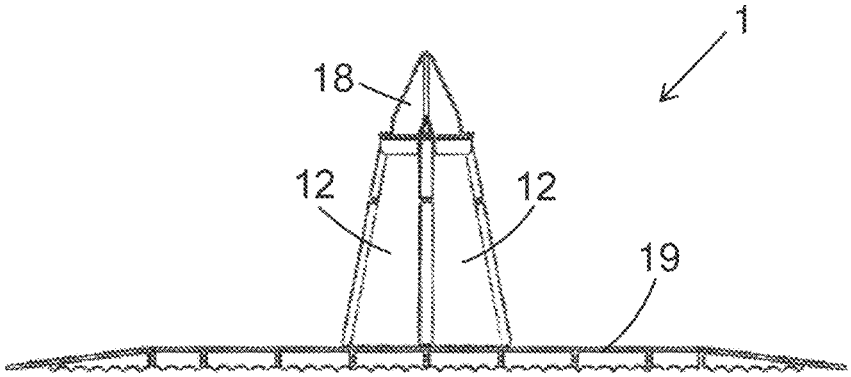
FIG. 10 schematically illustrates, according to an exemplary embodiment, a side view of collapsible barrier in an upright state, the collapsible barrier comprises a base and a cover.
Figure 11:
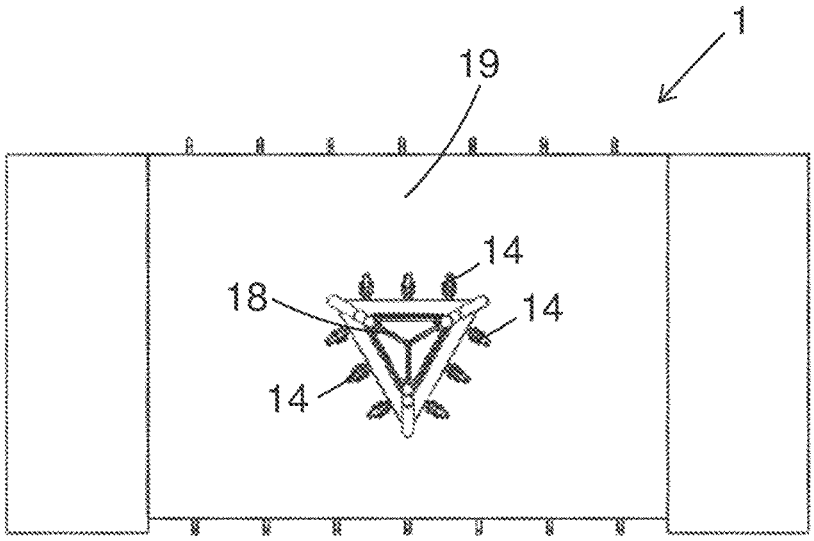
FIG. 11 schematically illustrates, according to an exemplary embodiment, a top view of collapsible barrier in an upright state, the collapsible barrier comprises a base and a cover.
Figure 12:
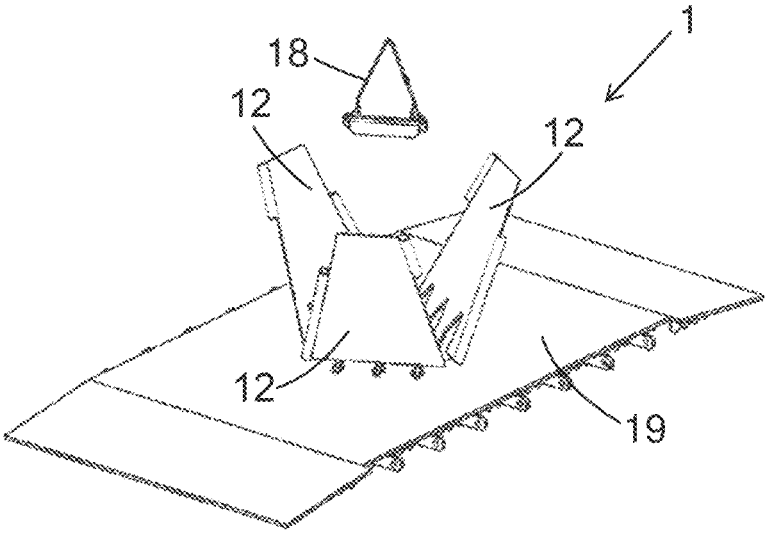
FIG. 12 schematically illustrates, according to an exemplary embodiment, a front perspective view of collapsible barrier in an intermediate state, the collapsible barrier comprises a base and a cover.
Figure 13:
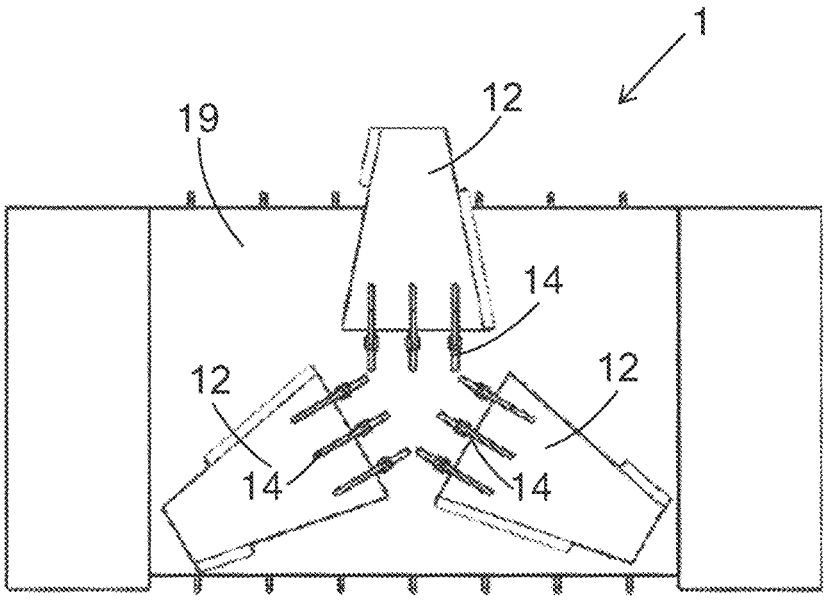
FIG. 13 schematically illustrates, according to an exemplary embodiment, a top view of collapsible barrier in a horizontal state, the collapsible barrier comprises a base and a cover.
Figure 14:
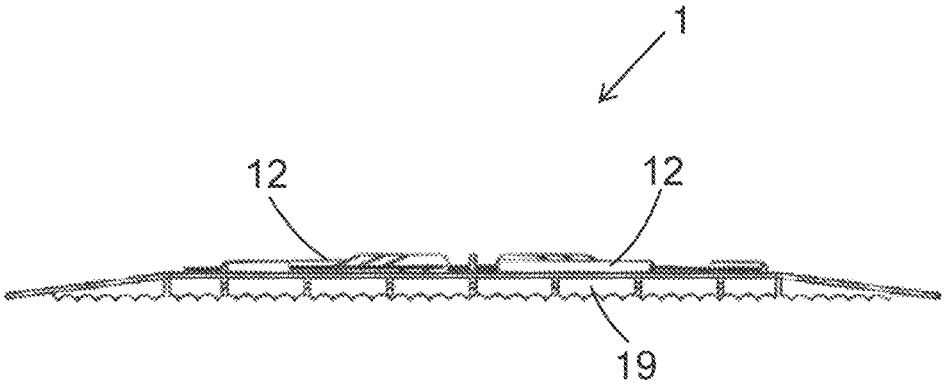
FIG. 14 schematically illustrates, according to an exemplary embodiment, a side view of collapsible barrier in a horizontal state, the collapsible barrier comprises a base and a cover.

As can be seen in FIGS. 9-11, when the barrier 1 is in an upright state, the cover 18 is assembled with the collapsible elements 12 and covers the top part of the collapsible barrier. In order to collapse the barrier 1, the cover 18 is removed, as can be seen in FIG. 12. In FIG. 12, the cover 18 is removed, and this allows collapsing the collapsible elements 12 and bringing the collapsible elements 12 to an intermediate state. Then, the collapsible elements can be further collapsed and brought to a horizontal state, as shown in FIGS. 13-14. Thus, according to one embodiment, the cover 18 is configured to removably connect to the top of the collapsible barrier 1 when in an upright state.

Reference is now made to FIGS. 15A-15D schematically illustrating, according to an exemplary embodiment, front perspective views of stages of collapsing and erecting a collapsible barrier inter alia comprising a cover and a base.

Figure 15A:
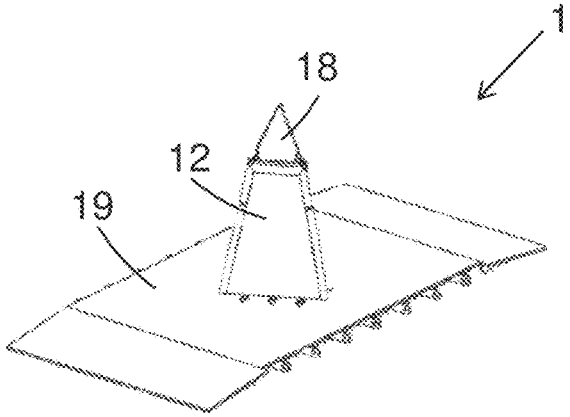
FIGS. 15A-D schematically illustrate, according to an exemplary embodiment, front perspective views of stages of collapsing and erecting a collapsible barrier inter alia comprising a cover and a base.
Figure 15B:
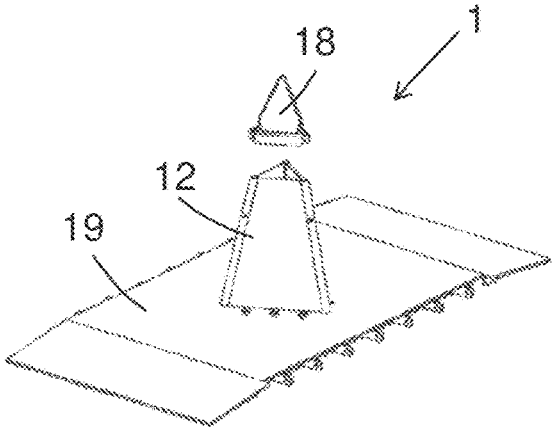
Figure 15C:
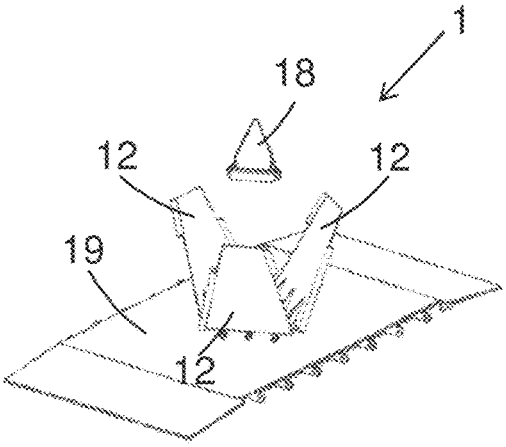
Figure 15D:
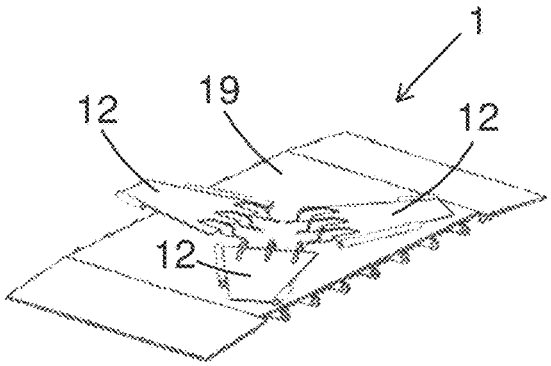
Figure 16:
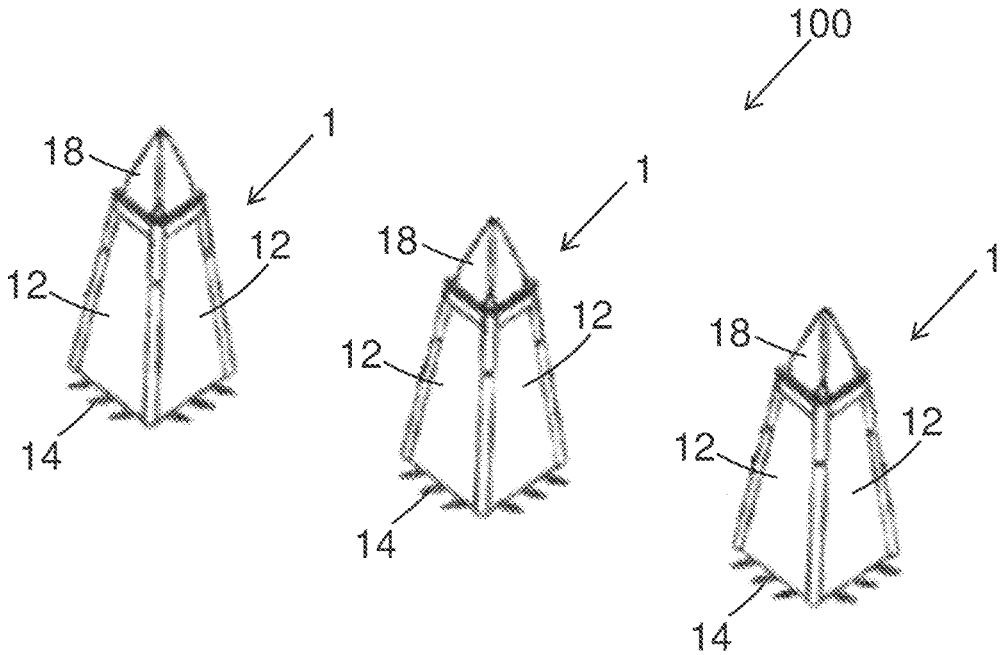
FIG. 16 schematically illustrates, according to an exemplary embodiment, a front perspective view of a collapsible barrier system comprising collapsible barriers in an upright state, each of the collapsible barriers comprises a cover.

FIG. 15A illustrates a collapsible barrier 1 in an upright state, when a cover 18 covers the top of the collapsible barrier, by being connected to the top edges 128 of the collapsible elements 12. FIG. 15B illustrates a collapsible barrier 1 in an upright state, when the cover 18 is removed from the top edges 128 of the collapsible elements 12. FIG. 15C illustrates a collapsible barrier 1 in an intermediate state, while the cover 18 is removed from the collapsible elements 12. FIG. 15D illustrates a collapsible barrier 1 in a horizontal (collapsed) state.

The present subject matter further provides a method for collapsing a collapsible barrier 1 from an upright state to a horizontal state, in embodiments according to which the collapsible barrier 1 comprises multiple collapsible elements 12 and a cover 18, the method comprising:

- providing a collapsible barrier 1 in an upright state, the collapsible barrier 1 covered with a cover 18, as illustrated in FIG. 15A;
- removing the cover 18 from the collapsible barrier 1, as illustrated in FIG. 15B;
- collapsing the collapsible elements 12 and bringing the collapsible elements 12 to an intermediate state, as illustrated in FIG. 15C; and
- further collapsing the collapsible elements 12 and bringing the collapsible elements 12 to a horizontal state, as illustrated in FIG. 15D.

The present subject matter provides in addition method for erecting a collapsible barrier 1 from a horizontal state to an upright state, in embodiments according to which the collapsible barrier 1 comprises multiple collapsible elements 12 and a cover 18, the method comprising:

- providing a collapsible barrier 12 in a horizontal state, as illustrated in FIG. 15D;
- erecting the collapsible elements 12 and bringing the collapsible elements 12 to an intermediate state, as illustrated in FIG. 15C;
- further erecting the collapsible elements 12 and bringing the collapsible elements 12 to an upright state, as illustrated in FIG. 15B; and
- covering the collapsible barrier 1 with a cover 18, as illustrated in FIG. 15A.

According to an embodiment of a collapsible barrier 1 not comprising a cover 18, the steps dealing with the cover 18 can be omitted from the methods for collapsing and erecting the collapsible barrier 1. The method can be performed manually or in a automatic matter from a control room, as an example, while the transition from state to state can be performed using a remote controller.

The present subject matter further provides a collapsible barrier system, comprising multiple collapsible barriers 1. According to one embodiment, the collapsible barrier system 100 comprises multiple collapsible barriers 1 according to embodiments described herein. According to another embodiment, the collapsible barrier system 100 comprises any type of collapsible barrier 1 described herein, and in any combination, for example the collapsible barrier system can comprise a collapsible barrier 1 comprising a cover 18 and a collapsible barrier 1 not comprising a cover 18.

Reference is now made to FIGS. 16 to 19 schematically illustrating, according to an exemplary embodiment, a front perspective view of a collapsible barrier system comprising collapsible barriers in an upright state, each of the collapsible barriers comprises a cover and a base, respectively, and perspective view as well as top view of the barrier system in horizontal state.

The collapsible barrier system 100 illustrated for example in FIGS. 16-19 comprises three collapsible barriers 1. It should be noted that the amount of three collapsible barriers 1 in the collapsible barrier system 100 is exemplary only, and should not be considered as limiting the scope of the present subject matter. Any number of collapsible barriers 1 in the collapsible barrier system 100 is under the scope of the present subject matter and according to the needs of a specific case.

Figure 17:
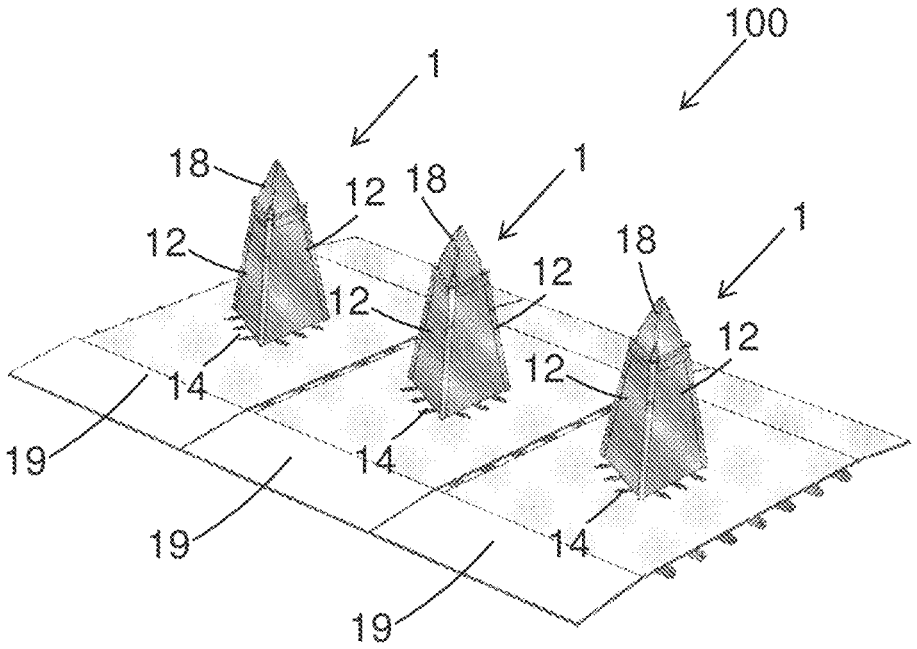
FIG. 17 schematically illustrates, according to an exemplary embodiment, a front perspective view of a collapsible barrier system comprising collapsible barriers in an upright state, each of the collapsible barriers comprises a cover and a base.
Figure 18:
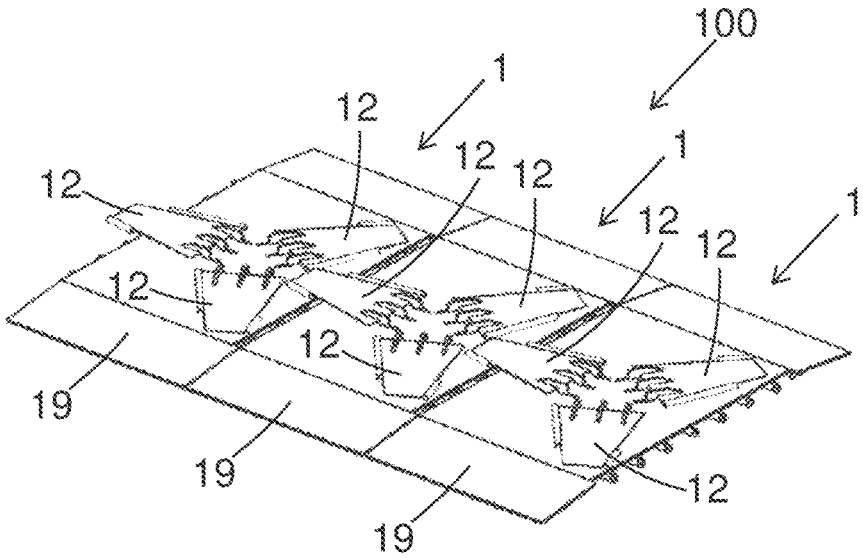
FIG. 18 schematically illustrates, according to an exemplary embodiment, a front perspective view of a collapsible barrier system comprising collapsible barriers in a horizontal state, each of the collapsible barriers comprises a base.
Figure 19:
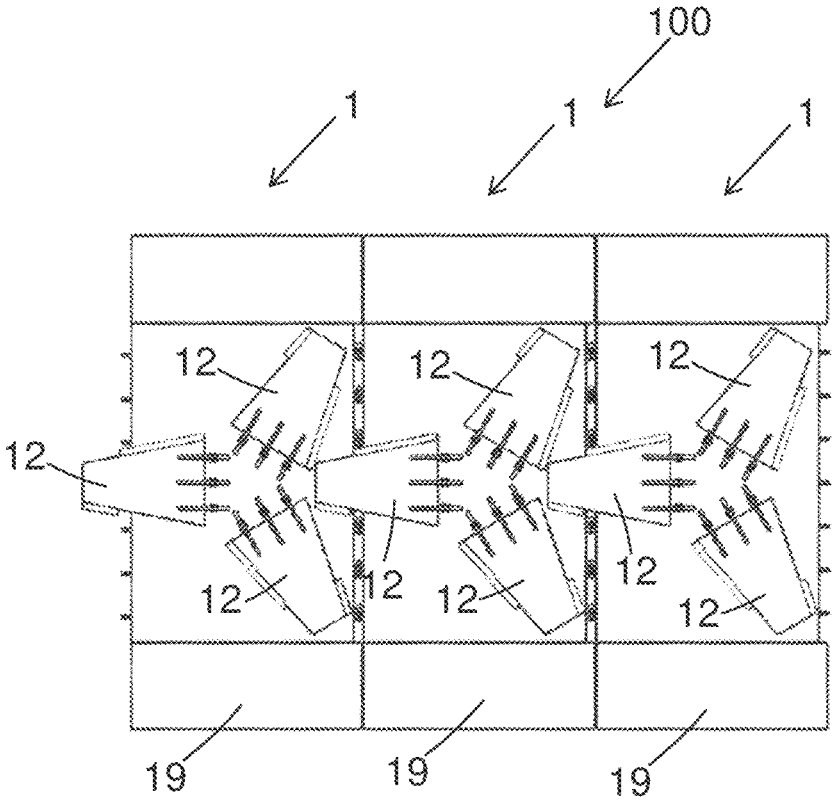
FIG. 19 schematically illustrates, according to an exemplary embodiment, a top view of a collapsible barrier system comprising collapsible barriers in a horizontal state, each of the collapsible barriers comprises a base.

According to one embodiment, the base 19 of a collapsible barrier 1 is configured to be connected to a base 19 of an adjacent collapsible barrier 1 in a collapsible barrier system 100, for example as illustrated in FIG. 17. Any mechanism known in the art for connecting a base 19 of a collapsible barrier 1 to a base 19 of an adjacent collapsible barrier 1 is under the scope of the present subject matter, for example, by using connectors, wire threads, a cable ties, restraints, a combination thereof, and the like. According to one embodiment, the connection of a base 19 of a collapsible barrier 1 to a base 19 of an adjacent collapsible barrier 1 is permanent. According to another embodiment, the connection of a base 19 of a collapsible barrier 1 to a base 19 of an adjacent collapsible barrier 1 is removable, namely temporary.

According to one embodiment, the state of each collapsible barrier 1 of the collapsible barrier system 1 depends on the state of at least one another collapsible barrier 1 of the collapsible barrier system 100. For example, all the collapsible barriers 1 of the collapsible barrier system 100 are in the same state, for example upright state, as illustrated for example in FIGS. 16-17, or horizontal state, as illustrated for example in FIGS. 18-19. In another example, two collapsible barriers 1 of the collapsible barrier system 1 are in the same state, while the state of other collapsible elements 1 of the collapsible barrier system 100 can be different.

Figure 20:
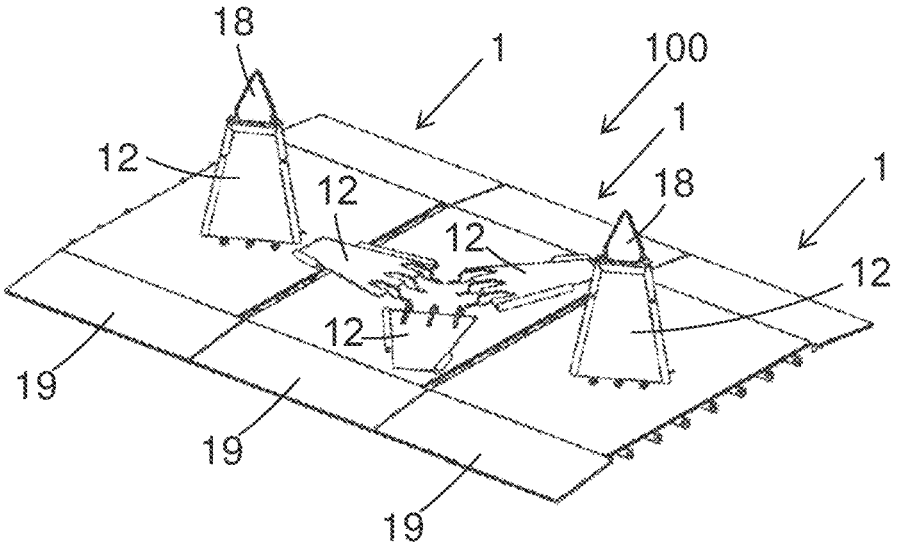
FIG. 20 schematically illustrates, according to an exemplary embodiment, a front perspective view of a collapsible barrier system comprising two collapsible barriers in an upright state and a collapsible barrier in between in a horizontal state, each of the collapsible barriers comprises a base.
Figure 21:
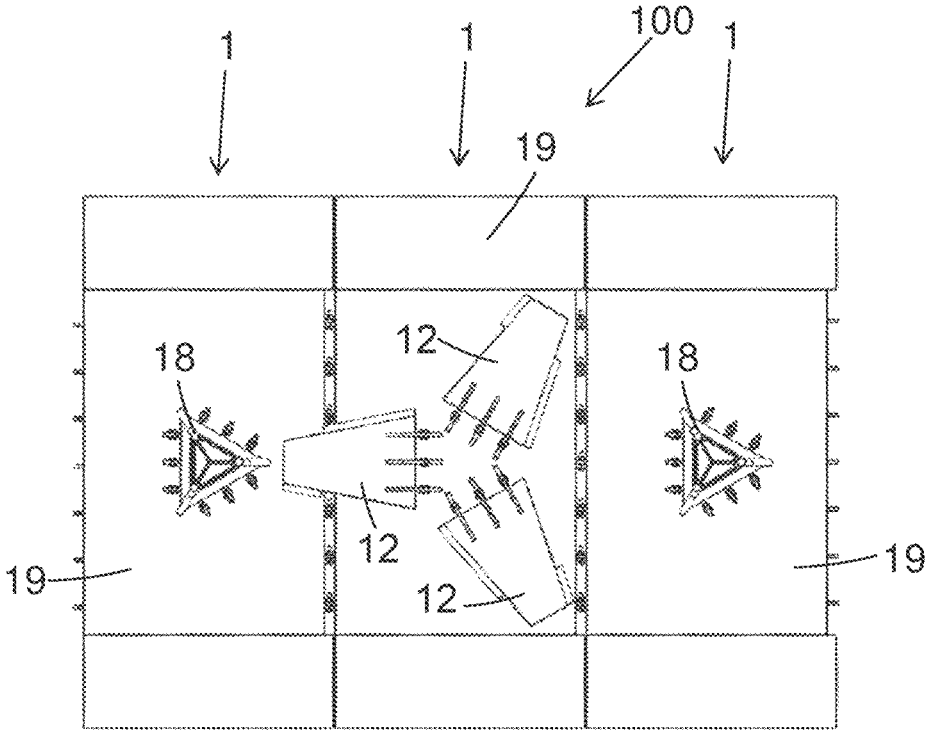
FIG. 21 schematically illustrates, according to an exemplary embodiment, a top view of a collapsible barrier system comprising two collapsible barriers in an upright state and a collapsible barrier in between in a horizontal state, each of the collapsible barriers comprises a base.
Figure 22:
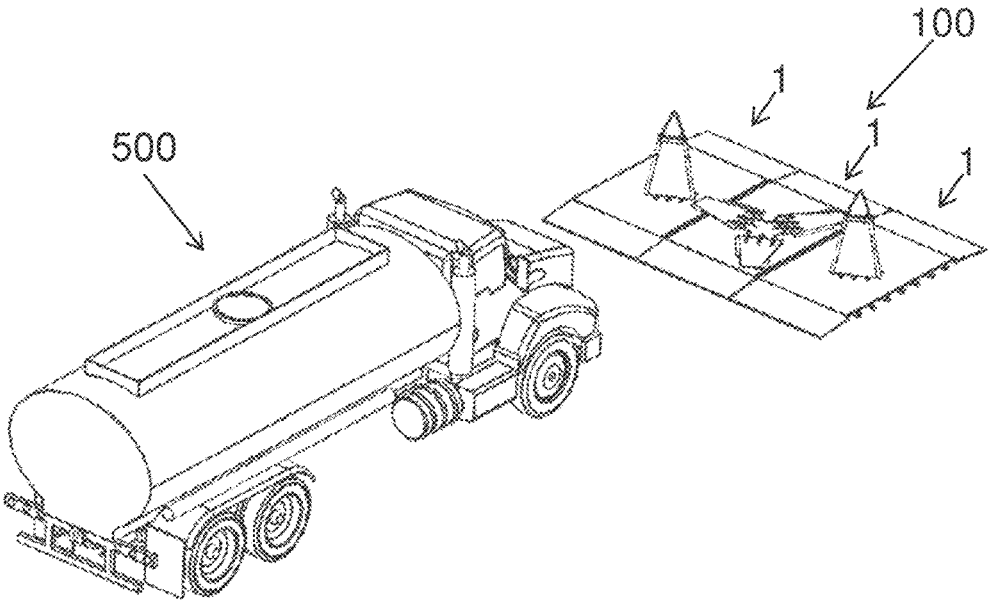
FIG. 22 schematically illustrates, according to an exemplary embodiment, a back-perspective view of a collapsible barrier system comprising two collapsible barriers in an upright state and a collapsible barrier in between in a horizontal state, and a vehicle approaching the collapsible barrier system.
Figure 23:
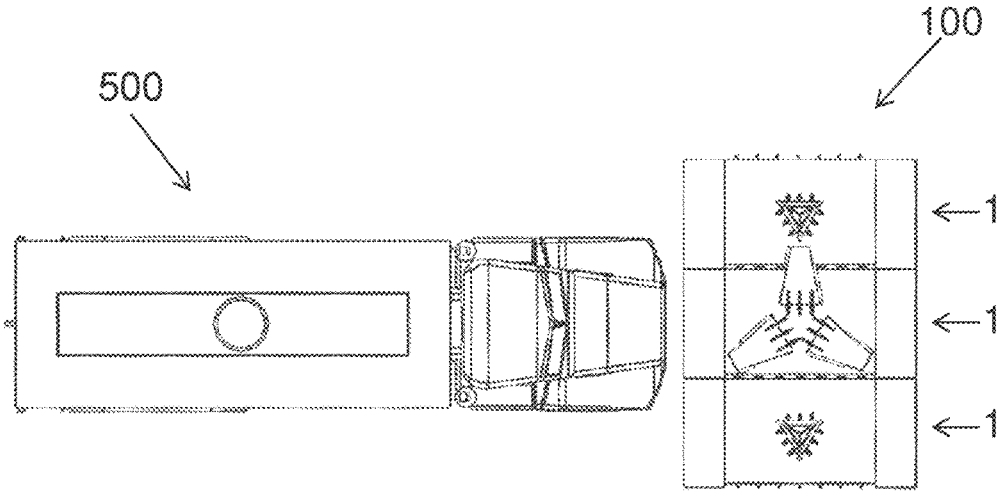
FIG. 23 schematically illustrates, according to an exemplary embodiment, a top view of a collapsible barrier system comprising two collapsible barriers in an upright state and a collapsible barrier in between in a horizontal state, and a vehicle approaching the collapsible barrier system.
Figure 24:
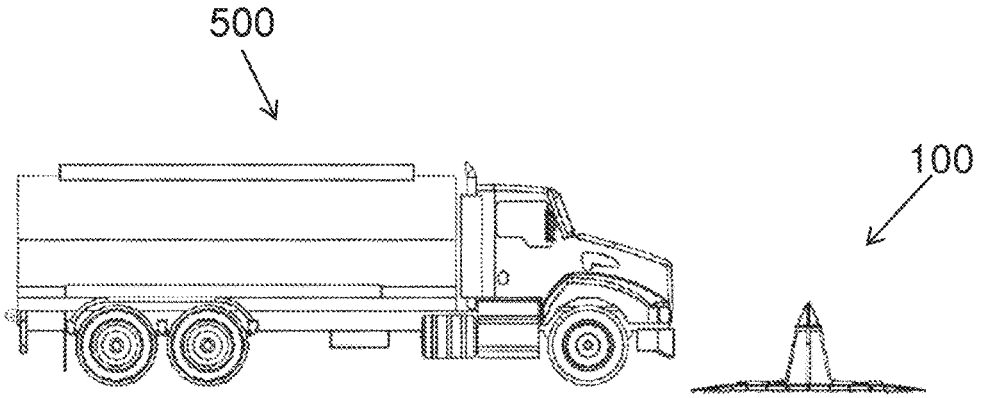
FIG. 24 schematically illustrates, according to an exemplary embodiment, a side view of a collapsible barrier system comprising two collapsible barriers in an upright state and a collapsible barrier in between in a horizontal state, and a vehicle approaching the collapsible barrier system.
Figure 25:
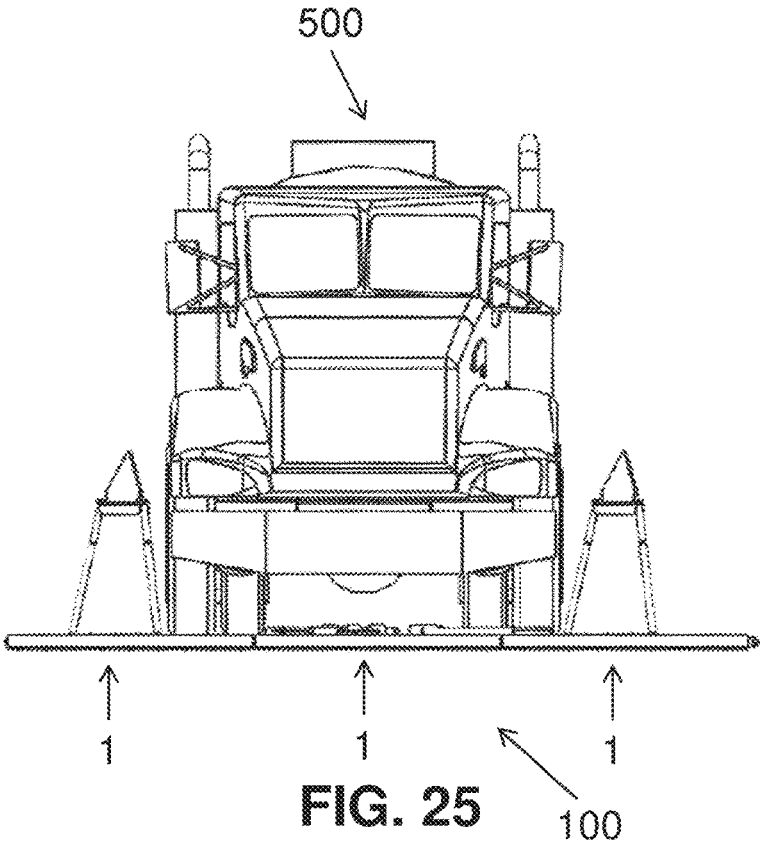
FIG. 25 schematically illustrates, according to an exemplary embodiment, a front view of a collapsible barrier system comprising two collapsible barriers in an upright state and a collapsible barrier in between in a horizontal state, and a vehicle passing through the collapsible barrier system.
Figure 26:
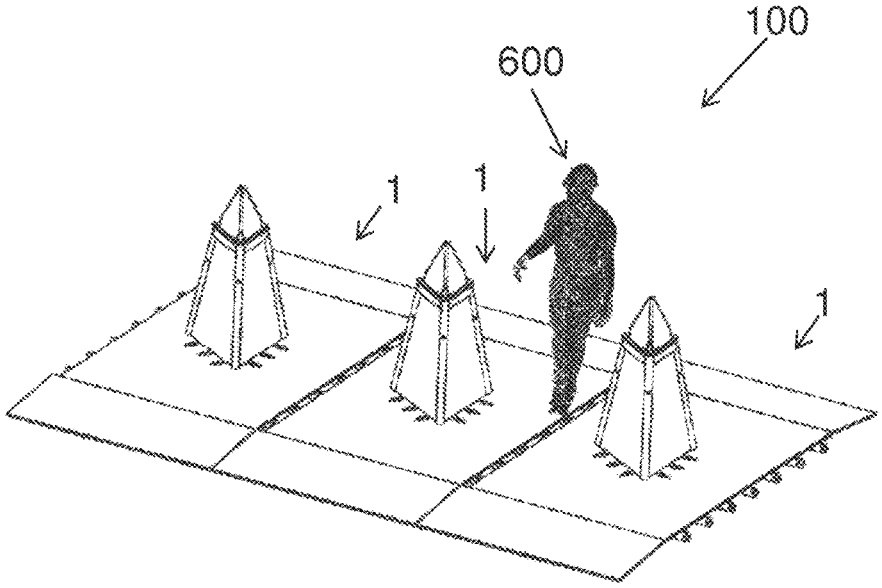
FIG. 26 schematically illustrates, according to an exemplary embodiment, a front perspective view of a collapsible barrier system comprising three collapsible barriers in an upright state, and a pedestrian passing through the collapsible barrier system.
Figure 27:
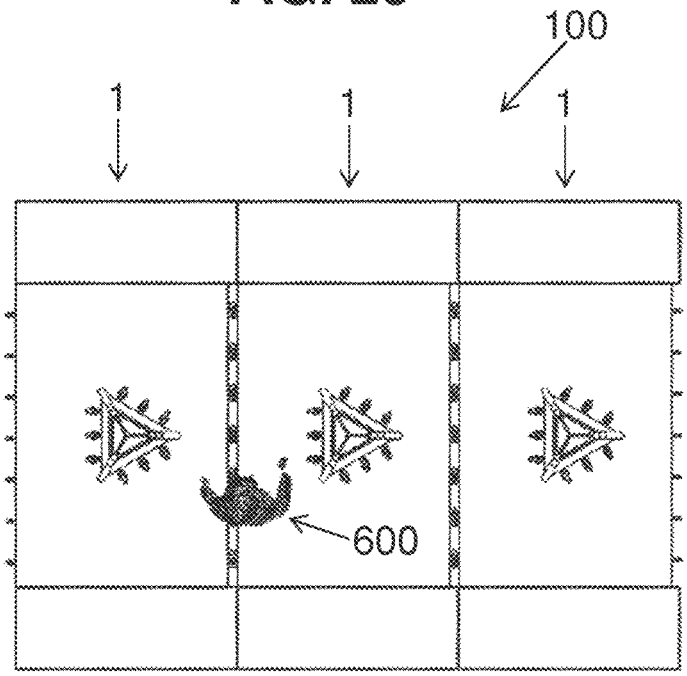
FIG. 27 schematically illustrates, according to an exemplary embodiment, a top view of a collapsible barrier system comprising three collapsible barriers in an upright state, and a pedestrian passing through the collapsible barrier system.
Figure 28:
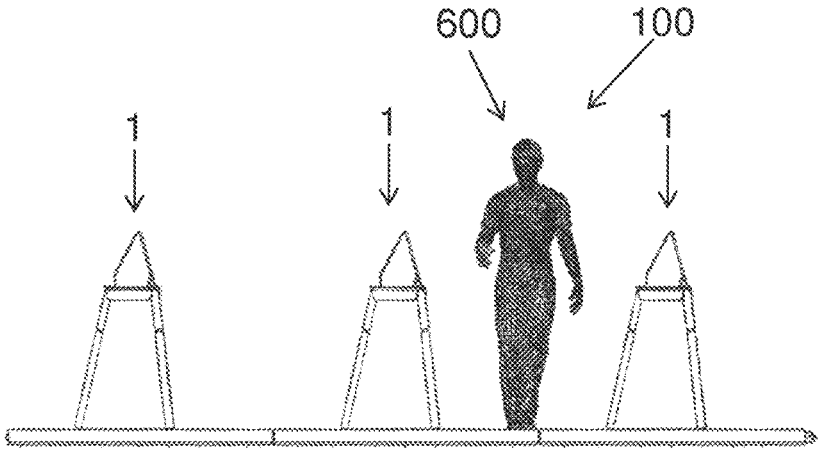
FIG. 28 schematically illustrates, according to an exemplary embodiment, a front view of a collapsible barrier system comprising three collapsible barriers in an upright state, and a pedestrian passing through the collapsible barrier system.
Figure 29:
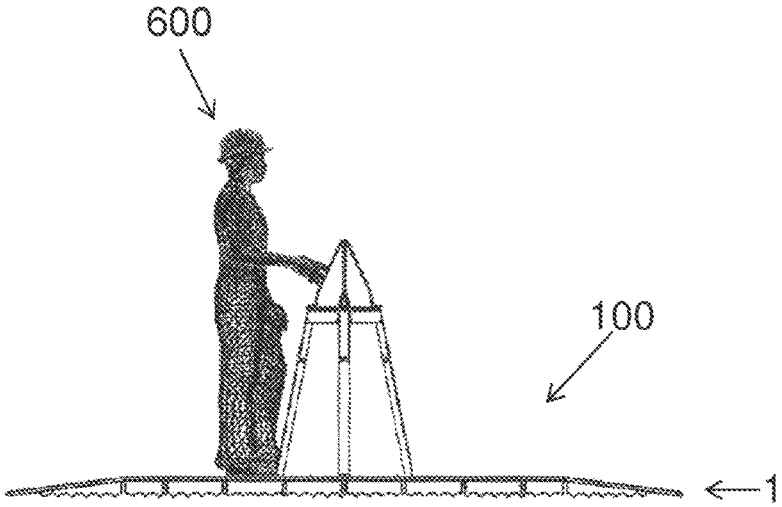
FIG. 29 schematically illustrates, according to an exemplary embodiment, a side view of a collapsible barrier system comprising three collapsible barriers in an upright state, and a pedestrian passing through the collapsible barrier system.

Reference is now made to FIGS. 20 and 21 schematically illustrating, according to an exemplary embodiment, a front perspective and top views, respectively, of a collapsible barrier system comprising two collapsible barriers in an upright state and a collapsible barrier in between in a horizontal state, each of the collapsible barriers comprises a base.

According to one embodiment, the state of each collapsible barrier 1 of the collapsible barrier system 100 is independent of the state of any other collapsible barrier 1 of the collapsible barrier system 100. For example, a collapsible barrier 1 of a collapsible barrier system 1 can be in an upright state, while another collapsible barrier 1 of the collapsible barrier system 100 is in a horizontal state, and the like. In another embodiment, illustrated in FIGS. 20-21, in a collapsible barrier system 100 comprising three collapsible barriers 1, two collapsible barriers 1 can be in an upright state, while a collapsible barrier 1 in between can be in a horizontal (collapsed) state.

Reference is now made to FIGS. 22-25 schematically illustrating, according to an exemplary embodiment, a back perspective view, a top view, a side view, a front view, respectively, of a collapsible barrier system comprising two collapsible barriers in an upright state and a collapsible barrier in between in a horizontal state, and a vehicle approaching the collapsible barrier system.

According to one embodiment, the collapsible barrier system 100 is configured to block passage of a vehicle 500. This is achieved, for example, by placing at least one collapsible barrier 1 in an upright state, across a ground, for example, in a place where it is desired to block passage of a vehicle 500. The at least one collapsible barrier 1, in the upright state, is configured to block passage of a vehicle 500. Furthermore, the collapsible barriers 1 of the collapsible barrier system 100 can be arranged in such a way that a vehicle 600 is unable to pass through gaps between the collapsible barriers 1 of the system.

However, sometimes there is a need to allow passage of a vehicle 500 through the collapsible barrier system 100. In prior art barriers, there can be a need to remove the barrier entirely from the way of the vehicle 500 in order to allow passage of the vehicle 500. An advantage of the collapsible barrier 1 and the collapsible barrier system 100 of the present subject matter over prior art barriers is that there is no need to remove the collapsible barrier 1 from it's place of placement. Instead, a collapsible barrier 1, or more than one collapsible barrier 1, is simply brought to a horizontal state according to embodiments described herein, in order to allow passage of a vehicle 500. Such an example is illustrated in FIGS. 22-25. A collapsible barrier system 100, comprising for example three collapsible barriers 1, is placed on a way of a vehicle. In order to prevent passage of a vehicle 500, all the collapsible barriers 1, for example, can be in an upright position. Thus, the vehicle 500 in not capable of passing through the collapsible barriers 1 and not through gaps between the collapsible barriers 1. However, in order to allow passage of a vehicle 500, according to the example illustrated in FIGS. 22-25, a collapsible barrier 1 that is arranged in the middle of the system can be brought to a horizontal state. This allows passage of the vehicle 500 over the collapsible barrier 1 in the horizontal state. In addition, the collapsible barriers 1 are arranged in such a way that the gap between the two collapsible barriers 1 that remain in the upright state is such that the vehicle 500 is able to pass through the gap, as can be seen for example in FIGS. 23 and 25.

Reference is now made to FIGS. 26-29 schematically illustrating, according to an exemplary embodiment, a front perspective view, a top view, a front view, a side view, respectively, of a collapsible barrier system comprising three collapsible barriers in an upright state, and a pedestrian passing through the collapsible barrier system.

According to one embodiment, the collapsible barrier system 1 is configured to block passage of a vehicle as described herein. According to another embodiment, the collapsible barrier system 1 is configured to allow passage of a vehicle, as described herein. According to a further embodiment, the collapsible barrier system 100 is configured to allow passage of a passenger, or multiple passengers, in any case. As can be seen in FIGS. 26-29, the gaps between the collapsible barriers 1 of a collapsible barrier system 100 allow passage of a pedestrian 600 through them, when the collapsible barriers 1 are in an upright state, and of-course when the collapsible barriers 1 are in a horizontal (collapsed) state.

It should be noted that the barrier and its elements are made of a hard material such as metal, reinforced material, composite material, a combination therewith, or the like so as to be able to endure an impact if a vehicle and prevent its passing through when the barrier is in an uptight state.

It is appreciated that certain features of the subject matter, which are, for clarity, described in the context of separate embodiments, can also be provided in combination in a single embodiment. Conversely, various features of the subject matter, which are, for brevity, described in the context of a single embodiment, can also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A collapsible barrier system for blocking vehicles attempting to cross the collapsible barrier system on a surface, the collapsible barrier system comprising at least one collapsible barrier arranged across the surface, each of the collapsible barriers being pivotally connected to the surface and comprising multiple collapsible elements adjacently arranged one next to the other in an enclosed structure, wherein the multiple collapsible elements are similar in shape and wherein each one of the multiple collapsible elements has a bottom edge, a first side edge, and a second side edge, wherein the bottom edge is connected to the surface and configured to pivot relative to the surface to allow the enclosed structure to move between an upright state in which the barrier blocks vehicles from passing and a collapsed state in which the multiple collapsible elements are outwardly collapsed to a horizontal position on the surface to allow vehicles to pass through.

2. The collapsible barrier system of claim 1, wherein the collapsible elements are shaped substantially as triangles or as quadrangles.

3. The collapsible barrier system of claim 1, wherein each one of the plurality of collapsible barriers is independent so that each collapsible barrier can be in an upright state or collapsed state without dependence on other collapsible barriers.

4. The collapsible barrier system of claim 1, further comprising at least one light source.

5. The collapsible barrier system of claim 1, wherein an intermediate state is a transition state between the upright state and the collapsed state.

6. The collapsible barrier system of claim 1, further comprising a cover configured to connect to a top of the multiple collapsible barrier when in an upright state.

7. The collapsible barrier system of claim 1, wherein the multiple collapsible elements are configured to be removably connected one to the other when in an upright state.

8. The collapsible barrier system of claim 1, wherein each of the multiple collapsible elements further comprises at least one hinge attached to the bottom edge, and configured to be fixed to the surface.

9. The collapsible barrier system of claim 8, wherein the at least one hinge is configured to be permanently fixed to the surface or to be removably fixed to the surface.

10. The collapsible barrier system of claim 8, wherein the hinge is configured to be fixed to the surface in a manner that withstands an impact of a moving vehicle.

11. The collapsible barrier system of claim 1, wherein the collapsible elements are configured to form an enclosed shape when in an upright state.

12. The collapsible barrier system of claim 11, wherein the enclosed shape of the collapsible elements allows at least partial attachment of the at least first side edge and the second side edge of adjacent collapsible elements in an upright state.

13. The collapsible barrier system of claim 1, wherein the multiple collapsible elements are configured to be erected and collapsed manually or automatically.

14. The collapsible barrier system of claim 1, further comprising a plurality of bases, each configured to serve as the surface to which the collapsible barrier is fixed.

15. The collapsible barrier system of claim 14, wherein each of the plurality of bases of the plurality of collapsible barriers is configured to be permanently or removably connected to another base of an adjacent collapsible barrier.

16. The collapsible barrier system of claim 14, wherein the plurality of bases is configured to be permanently or removably placed on a ground.

17. The collapsible barrier system of claim 16, wherein the plurality of bases is configured to be portable.

* * * * *